US007552598B2

(12) United States Patent
Paradowski

(10) Patent No.: US 7,552,598 B2
(45) Date of Patent: Jun. 30, 2009

(54) PROCESS FOR SUB-COOLING AN LNG STREAM OBTAINED BY COOLING BY MEANS OF A FIRST REFRIGERATION CYCLE, AND ASSOCIATED INSTALLATION

(75) Inventor: Henri Paradowski, Cergy (FR)

(73) Assignee: Technip France (FR)

( * ) Notice: Subject to any disclaimer, the term of this patent is extended or adjusted under 35 U.S.C. 154(b) by 390 days.

(21) Appl. No.: 11/399,768

(22) Filed: Apr. 7, 2006

(65) Prior Publication Data

US 2006/0225461 A1 Oct. 12, 2006

(30) Foreign Application Priority Data

Apr. 11, 2005 (FR) ..... 05 03575

(51) Int. Cl.
*F25J 1/00* (2006.01)

(52) U.S. Cl. ..... 62/611; 62/612

(58) Field of Classification Search ..... 62/611, 62/612

See application file for complete search history.

(56) References Cited

U.S. PATENT DOCUMENTS

| | | | | |
|---|---|---|---|---|
| 3,559,418 | A * | 2/1971 | Hoffman | 62/622 |
| 3,818,714 | A | 6/1974 | Etzbach et al. | 62/11 |
| 4,334,902 | A * | 6/1982 | Paradowski | 62/614 |
| 6,082,136 | A * | 7/2000 | Yoshino | 62/652 |
| 6,308,531 | B1 | 10/2001 | Roberts et al. | 62/611 |
| 2003/0089125 | A1 | 5/2003 | Fredheim et al. | 62/612 |
| 2004/0182108 | A1 | 9/2004 | Roberts | 62/612 |
| 2004/0255617 | A1 | 12/2004 | Paradowski | 62/612 |
| 2005/0056051 | A1 * | 3/2005 | Roberts et al. | 62/612 |

FOREIGN PATENT DOCUMENTS

| | | |
|---|---|---|
| DE | 24 40 215 | 8/1974 |
| GB | 896663 | 5/1962 |

OTHER PUBLICATIONS

French Search Report FR0503575 dated Dec. 14, 2005.

* cited by examiner

*Primary Examiner*—William C Doerrler
(74) *Attorney, Agent, or Firm*—Ostrolenk, Faber, Gerb & Soffen, LLP

(57) ABSTRACT

In this process, the LNG stream is sub-cooled with a refrigerating fluid in a first heat exchanger. This refrigerating fluid undergoes a closed second refrigeration cycle which is independent of the first cycle. The closed cycle comprises a phase of heating the refrigerating fluid in a second heat exchanger, and a phase of compressing the refrigerating fluid in a compression apparatus to a pressure greater than its critical pressure. It further comprises a phase of cooling the refrigerating fluid originating from the compression apparatus in the second heat exchanger and a phase of dynamically expanding of a proportion of the refrigerating fluid issuing from the second heat exchanger in a turbine. The refrigerating fluid is formed by a mixture of nitrogen-containing fluids.

24 Claims, 7 Drawing Sheets

PROCESS FOR SUB-COOLING AN LNG STREAM OBTAINED BY COOLING BY MEANS OF A FIRST REFRIGERATION CYCLE, AND ASSOCIATED INSTALLATION

TECHNICAL FIELD OF THE INVENTION

The present invention relates to a process for sub-cooling an LNG stream obtained by cooling by means of a first refrigeration cycle, the process being of the type comprising the following steps:

(a) the LNG stream brought to a temperature of less than −90° C. is introduced into a first heat exchanger;

(b) the LNG stream is sub-cooled in the first heat exchanger by heat exchange with a refrigerating fluid;

(c) the refrigerating fluid is subjected to a closed second refrigeration cycle which is independent of said first cycle, the closed refrigeration cycle comprising the following successive phases:

(i) the refrigerating fluid issuing from the first heat exchanger, kept at a low pressure, is heated in a second heat exchanger;

(ii) the refrigerating fluid issuing from the second heat exchanger is compressed in a compression apparatus to a high pressure greater than its critical pressure;

(iii) the refrigerating fluid originating from the compression apparatus is cooled in the second heat exchanger;

(iv) at least a proportion of the refrigerating fluid issuing from the second heat exchanger is dynamically expanded in a cold turbine;

(v) the refrigerating fluid issuing from the cold turbine is introduced into the first heat exchanger.

BACKGROUND OF THE INVENTION

U.S. Pat. No. 6,308,531 discloses a process of the aforementioned type, in which a natural gas stream is liquefied by means of a first refrigeration cycle involving the condensation and vaporisation of a hydrocarbon mixture. The temperature of the gas obtained is approximately −100° C. Then, the LNG produced is sub-cooled to approximately −170° C. by means of a second refrigeration cycle known as a "reverse Brayton cycle" comprising a staged compressor and a gas expansion turbine. The refrigerating fluid used in this second cycle is nitrogen.

A process of this type is not completely satisfactory. The maximum yield of the cycle known as the reverse Brayton cycle is limited to approximately 40%.

An object of the invention is therefore to provide an autonomous process for sub-cooling an LNG stream, which has an improved yield and can easily be employed in units of various structures.

SUMMARY OF THE INVENTION

The invention accordingly relates to a sub-cooling process of the aforementioned type, characterised in that the refrigerating fluid is formed by a mixture of nitrogen-containing fluids.

The process according to the invention can comprise one or more of the following characteristics, taken in isolation or any technically possible combination:

the refrigerating fluid comprises nitrogen and at least one hydrocarbon;

the refrigerating fluid contains nitrogen and methane;

during step (iii), the refrigerating fluid originating from the compression apparatus is placed in a heat exchange relationship with a secondary refrigerating fluid circulating in the second heat exchanger, the secondary refrigerating fluid undergoing a third refrigeration cycle in which it is compressed at the outlet of the second heat exchanger, cooled and at least partially condensed, then expanded before it is vaporised in the second heat exchanger;

the secondary refrigerating fluid comprises propane;

after step (iii), (iii1) the refrigerating fluid issuing from the compression apparatus is separated into a sub-cooling stream and a secondary cooling stream;

(iii2) the secondary cooling stream is expanded in a secondary turbine;

(iii3) the secondary cooling stream issuing from the secondary turbine is mixed with the refrigerating fluid stream issuing from the first heat exchanger so as to form a stream of refrigerating mixture;

(iii4) the sub-cooling stream issuing from the step is placed in a heat exchange relationship with the stream of refrigerating mixture in a third heat exchanger;

(iii5) the sub-cooling stream issuing from the third heat exchanger is introduced into the cold turbine;

the secondary turbine is coupled to a compressor of the compression apparatus:

during step (iv), the refrigerating fluid is kept substantially in a gaseous form in the cold turbine;

during step (iv), the refrigerating fluid is liquefied to more than 95% by mass in the cold turbine;

the sub-cooling stream issuing from the third heat exchanger is cooled before it passes into the cold turbine by heat exchange with the refrigerating fluid circulating in the first heat exchanger at the outlet of the cold turbine;

the refrigerating fluid contains a $C_2$ hydrocarbon; and the high pressure is greater than approximately 70 bar and the low pressure is less than approximately 30 bar.

The invention also relates to an installation for sub-cooling an LNG stream originating from a liquefaction unit comprising a first refrigeration cycle, the installation being of the type comprising:

LNG stream sub-cooling means comprising a first heat exchanger for placing the LNG stream in a heat exchange relationship with a refrigerating fluid; and a closed second refrigeration cycle which is independent of the first cycle and includes:

a second heat exchanger comprising means for circulating the refrigerating fluid issuing from the first heat exchanger;

a compression apparatus for the refrigerating fluid issuing from the second heat exchanger, capable of bringing said refrigerating fluid to a high pressure greater than its critical pressure;

means for circulating the refrigerating fluid issuing from the compression means in the second heat exchanger;

a cold turbine for dynamically expanding a least a proportion of the refrigerating fluid issuing from the second heat exchanger; and means for introducing the refrigerating fluid issuing from the cold turbine into the first heat exchanger;

characterised in that the refrigerating fluid is formed by a mixture of nitrogen-containing fluids.

The installation according to the invention can comprise one or more of the following characteristics, in isolation or any technically possible combination:

the refrigerating fluid comprises nitrogen and at least one hydrocarbon;

the refrigerating fluid contains nitrogen and methane;

the second heat exchanger comprises means for circulating a secondary refrigerating fluid, the installation comprising a third refrigeration cycle including in succession secondary compression means for the secondary refrigerating fluid issuing from the second heat exchanger, cooling and expanding means for the secondary refrigerating fluid issuing from the secondary compression means and means for introducing the secondary refrigerating fluid issuing from the expanding means into the second heat exchanger;

the secondary refrigerating fluid comprises propane;

the installation comprises:

means for separating the refrigerating fluid issuing from the compression apparatus so as to form a sub-cooling stream and a secondary cooling stream;

a secondary turbine for expanding the secondary cooling stream;

means for mixing the secondary cooling stream issuing from the secondary turbine with the refrigerating fluid stream issuing from the first heat exchanger so as to form a stream of mixture;

a third heat exchanger for placing the sub-cooling stream issuing from the separating means in a heat exchange relationship with the stream of mixture; and means for introducing the sub-cooling stream issuing from the third heat exchanger into the cold turbine;

the secondary turbine is coupled to a compressor of the compression apparatus;

the installation comprises, upstream of the cold turbine, means for introducing the sub-cooling stream issuing from the third heat exchanger into the first heat exchanger in order to place it in a heat exchange relationship with the refrigerating fluid circulating in the first heat exchanger at the outlet of the cold turbine; and the refrigerating fluid contains a $C_2$ hydrocarbon.

BRIEF DESCRIPTION OF THE DRAWINGS

Embodiments of the invention will now be described with reference to the accompanying drawings, in which.

DETAILED DESCRIPTION OF PREFERRED EMBODIMENTS

Figure 1:
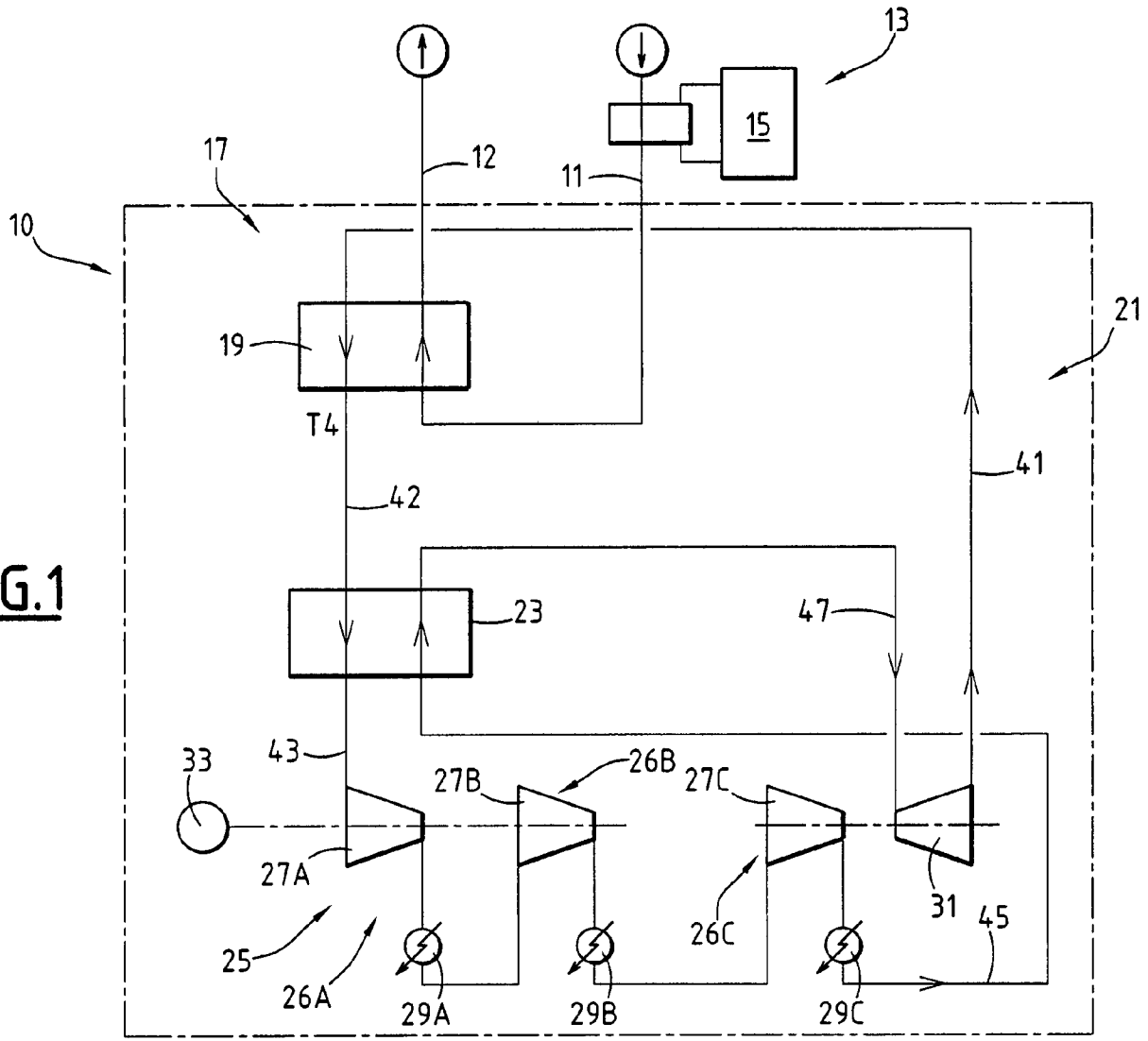
FIG. 1 is a block diagram of a first installation according to the invention.

The sub-cooling installation 10 according to the invention, shown in FIG. 1, is intended for the production, starting from a liquefied natural gas (LNG) stream 11 brought to a temperature of less than −90° C., of a sub-cooled LNG stream 12, brought to a temperature of less than −140° C.

As illustrated in FIG. 1, the starting LNG stream 11 is produced by a natural gas liquefaction unit 13 comprising a first refrigeration cycle 15. The first cycle 15 includes, for example, a cycle comprising condensation and vaporisation means for a hydrocarbon mixture.

The installation 10 comprises a first heat exchanger 19 and a closed second refrigeration cycle 21 which is independent of the first cycle 15.

The second refrigerating cycle 21 comprises a second heat exchanger 23, a staged compression apparatus 25 comprising a plurality of compression stages, each stage 26 comprising a compressor 27 and a condenser 29.

The second cycle 21 further comprises a expansion turbine 31 coupled to the compressor 27C of the last compression stage.

In the example shown in FIG. 1, the staged compression apparatus 25 comprises three compressors 27. The first and second compressors 27A and 27B are driven by the same external energy source 33, whereas the third compressor 27C is driven by the expansion turbine 31. The source 33 is, for example, a gas turbine-type motor.

The condensers 29 are water- and/or air-cooled.

Hereinafter, the same reference numeral designates a stream of liquid and the pipe carrying it, the pressures concerned are absolute pressures, and the percentages concerned are molar percentages.

The starting LNG stream 11 issuing from the liquefaction unit 13 is at a temperature of less than −90° C., for example at −110° C. This stream comprises, for example, substantially 5% nitrogen, 90% methane and 5% ethane, and its flow rate is 50,000 kmol/h.

The LNG stream 11 at −110° C. is introduced into the first heat exchanger 19, where it is sub-cooled to a temperature of less than −150° C. by heat exchange with a starting stream of refrigerating fluid 41 circulating in a counter-current in the first heat exchanger 19, so as to produce the sub-cooled LNG stream 12.

The starting stream 41 of refrigerating fluid comprises a mixture of nitrogen and methane. The molar content of methane in the refrigerating fluid 41 is between 5 and 15%. The refrigerating fluid 41 may have issued from a mixture of nitrogen and methane originating from the denitrogenation of the LNG stream 12 carried out downstream of the installation 11. The flow rate of the stream 41 is, for example, 73,336 kmol/h, and its temperature is −152° C. at the inlet of the exchanger 19.

The stream 42 of refrigerating fluid issuing from the heat exchanger 19 undergoes a closed second refrigeration cycle 21 which is independent of the first cycle 15.

The stream 42, which has a low pressure substantially between 10 and 30 bar, is introduced into the second heat exchanger 23 and heated in this exchanger 23 so as to form a stream 43 of heated refrigerating fluid.

The stream 43 is then compressed in succession in the three compression stages 26 so as to form a compressed stream of refrigerating fluid 45. In each stage 26, the stream 43 is compressed in the compressor 27, then cooled to a temperature of 35° C. in the condenser 29.

At the outlet of the third condenser 29C, the compressed stream of refrigerating fluid 45 has a high pressure greater than its critical pressure, or cricondenbar pressure. It is at a temperature substantially equal to 35° C.

The high pressure is preferably greater than 70 bar and between 70 bar and 100 bar. This pressure is preferably as high as possible, in view of the mechanical strength limits of the circuit.

The compressed stream of refrigerating fluid 45 is then introduced into the second heat exchanger 23, where it is cooled by heat exchange with the stream 42 issuing from the first exchanger 19 and circulating in a counter-current.

A cooled compressed stream 47 of refrigerating fluid is thus formed at the outlet of the second exchanger 23.

The stream 47 is expanded to the low pressure in the turbine 31 so as to form the starting stream 41 of refrigerating fluid. The stream 41 is substantially in a gaseous form, in other words contains less than 10% by mass (or 1% by volume) of liquid.

The stream 41 is then introduced into the first heat exchanger 19 where it is heated by heat exchange with the LNG stream 11 circulating in a counter-current.

As the high pressure is greater than the supercritical pressure, the refrigerating fluid is kept in a gaseous or supercritical form throughout the cycle 21.

It is thus possible to avoid the appearance of a large amount of liquid phase at the outlet of the turbine 31, and this enables the process to be carried out particularly easily. The exchanger 19 does not actually have a liquid and steam distribution device.

The refrigerating condensation of the stream 47 at the outlet of the second heat exchanger 23 is limited to less than 10% by mass, so a single expansion turbine 31 is used to expand the compressed stream of refrigerating fluid 47.

Figure 2:
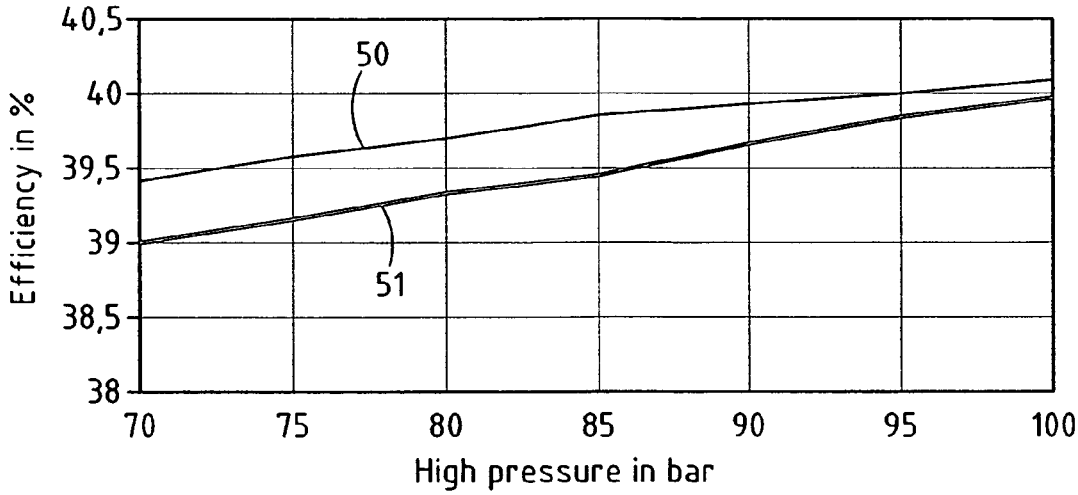
FIG. 2 is a graph showing the efficiency curves of the second refrigeration cycle of the installation in FIG. 1 and of a prior art installation as a function of the pressure of the refrigerating fluid at the outlet of the compressor.

In FIG. 2, the respective curves 50 and 51 of the respective efficiencies of the cycle 21 in the process according to the invention and in a prior art process are shown as a function of the high pressure value. In the prior art process, the refrigerating fluid consists solely of nitrogen. The addition of a quantity of methane of between 5 and 15 mol % to the refrigerating fluid significantly increases the efficiency of the cycle 21 in sub-cooling the LNG from −110° C. to −150° C.

The efficiencies shown in FIG. 2 have been calculated while considering the polytropic yield of the compressors 27A and 27B of 83%, the polytropic yield of the compressor 27C of 80%, and the adiabatic yield of the turbine 31 of 85%. Furthermore, the average temperature difference between the streams circulating in the first heat exchanger 19 is kept at approximately 4° C. The average temperature difference between the streams circulating in the second heat exchanger 23 is also kept at approximately 4° C.

This result is surprisingly obtained without modifying the installation 10, and allows gains of approximately 1,000 kW to be achieved with high pressures between 70 and 85 bar.

Figure 3:
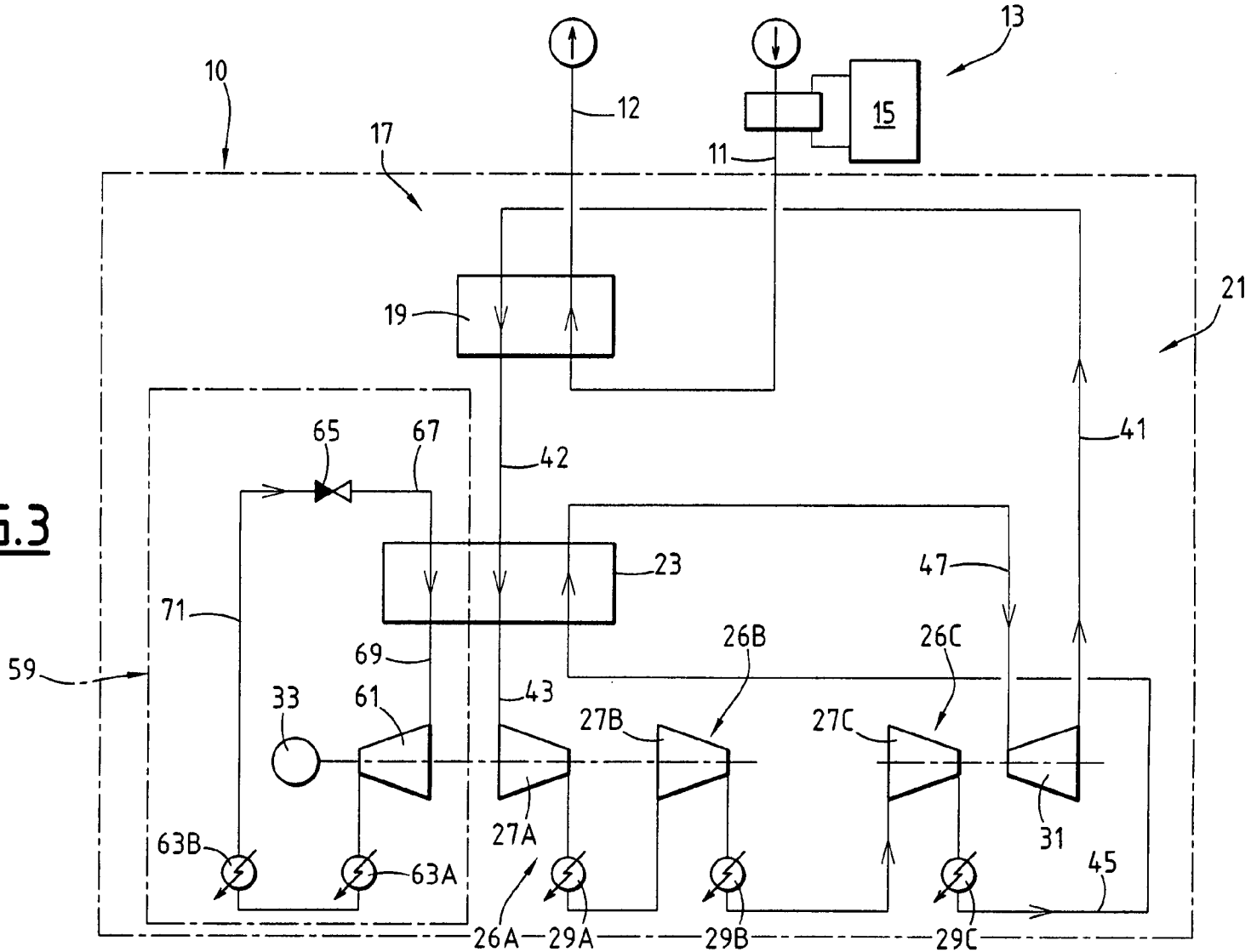
FIG. 3 is a diagram similar to that in FIG. 1 of a first variation of the first installation according to the invention.

In the first variation of the first process according to the invention, illustrated in FIG. 3, the installation 10 further comprises a closed third refrigeration cycle 59, which is independent of the cycles 15 and 21.

The third cycle 59 comprises a secondary compressor 61 driven by the external energy source 33, first and second secondary condensers 63A and 63B, and a expansion valve 65.

This cycle is implemented by means of a secondary refrigerating fluid stream 67 formed by liquid propane. The stream 67 is introduced into the second heat exchanger 23 simultaneously with the refrigerating fluid stream 42 issuing from the heat exchanger 19, and in a counter-current to the compressed stream of refrigerating fluid 45.

The vaporisation of the propane stream 67 in the second heat exchanger 23 cools the stream 45 by heat exchange and produces a heated propane stream 69. This stream 69 is subsequently compressed in the compressor 61, then cooled and condensed in the condensers 63A and 63B to form a liquid compressed propane stream 71. This stream 71 is expanded in the valve 65 to form the refrigerating propane stream 67.

The power consumed by the compressor 61 represents approximately 5% of the total power supplied by the energy source 33.

Figure 4:
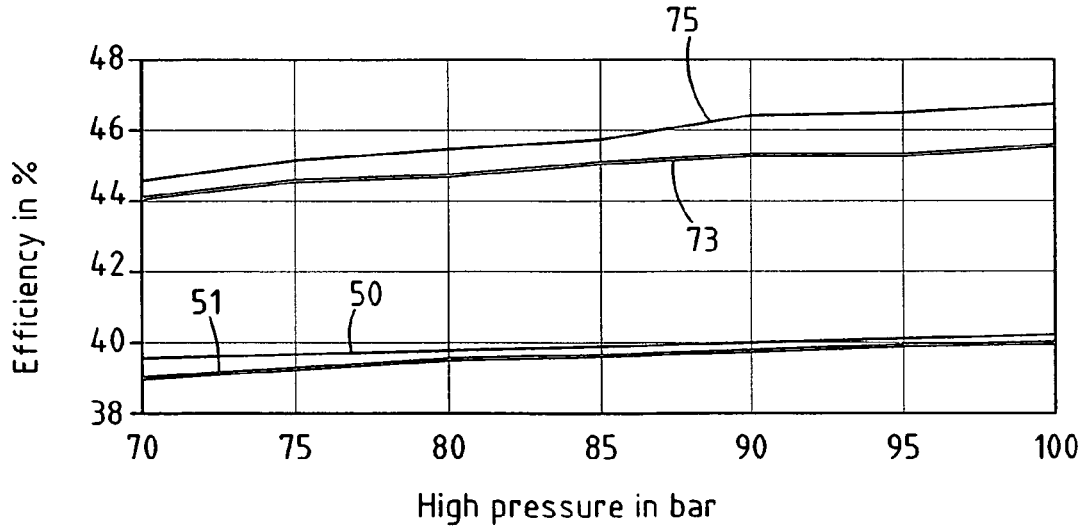
FIG. 4 is a graph similar to that in FIG. 2, for the installation of FIG. 3.

However, as illustrated in FIG. 4, the curve 73 of efficiency as a function of the high pressure for this first variation of process shows that the efficiency of the cycle 21 in the second process is increased by approximately 5% relative to the first process according to the invention in the high pressure range concerned.

Furthermore, the reduction in total power consumed at a high pressure of 80 bar is greater than 12%, relative to a prior art process.

Figure 5:
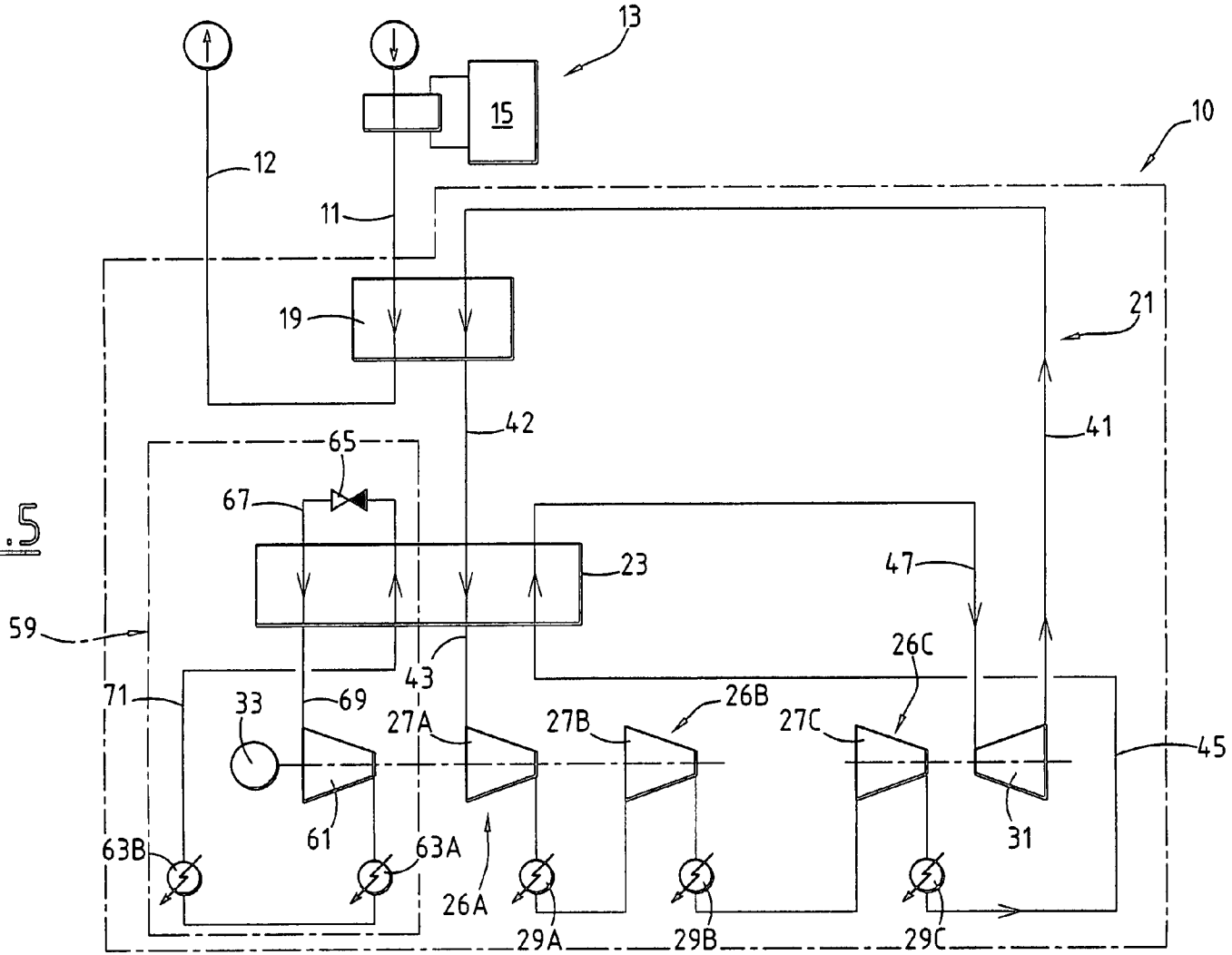
FIG. 5 is a diagram similar to that in FIG. 1 of a second variation of the first installation according to the invention.

The second variation of the first installation illustrated in FIG. 5 differs from the first variation by the following characteristics.

The refrigerating fluid used in the third cycle 59 comprises at least 30 mol % ethane. In the example illustrated, this cycle comprises approximately 50 mol % ethane and 50 mol % propane.

Furthermore, the secondary refrigerating fluid stream 71 obtained at the outlet of the second secondary condenser 63B is introduced into the second heat exchanger 23 where it is sub-cooled, prior to the expansion thereof in the valve 65, in a counter-current to the expanded stream 67.

As illustrated by the curve 75 representing the efficiency of the process in FIG. 4, the average efficiency of the cycle 21 increases by approximately 0.7% relative to the second variation shown in FIG. 3.

By way of illustration, the table below shows the pressure, temperature and flow rate values when the high pressure is 80 bar.

TABLE 1

| Stream | Temperature (° C.) | Pressure (bar absolute) | Flow rate (kmol/h) |
|---|---|---|---|
| 11 | −110.0 | 50.0 | 50,000 |
| 12 | −150.0 | 49.0 | 50,000 |
| 41 | −152.5 | 19.3 | 73,336 |
| 42 | −112.2 | 19.1 | 73,336 |
| 43 | 33.6 | 18.8 | 73,336 |
| 45 | 35.0 | 80.0 | 73,336 |
| 47 | −94.0 | 79.5 | 73,336 |
| 67 | −46.0 | 3.5 | 2,300 |
| 69 | 20.0 | 3.2 | 2,300 |
| 71 | 35 | 31.9 | 2,300 |

Figure 6:
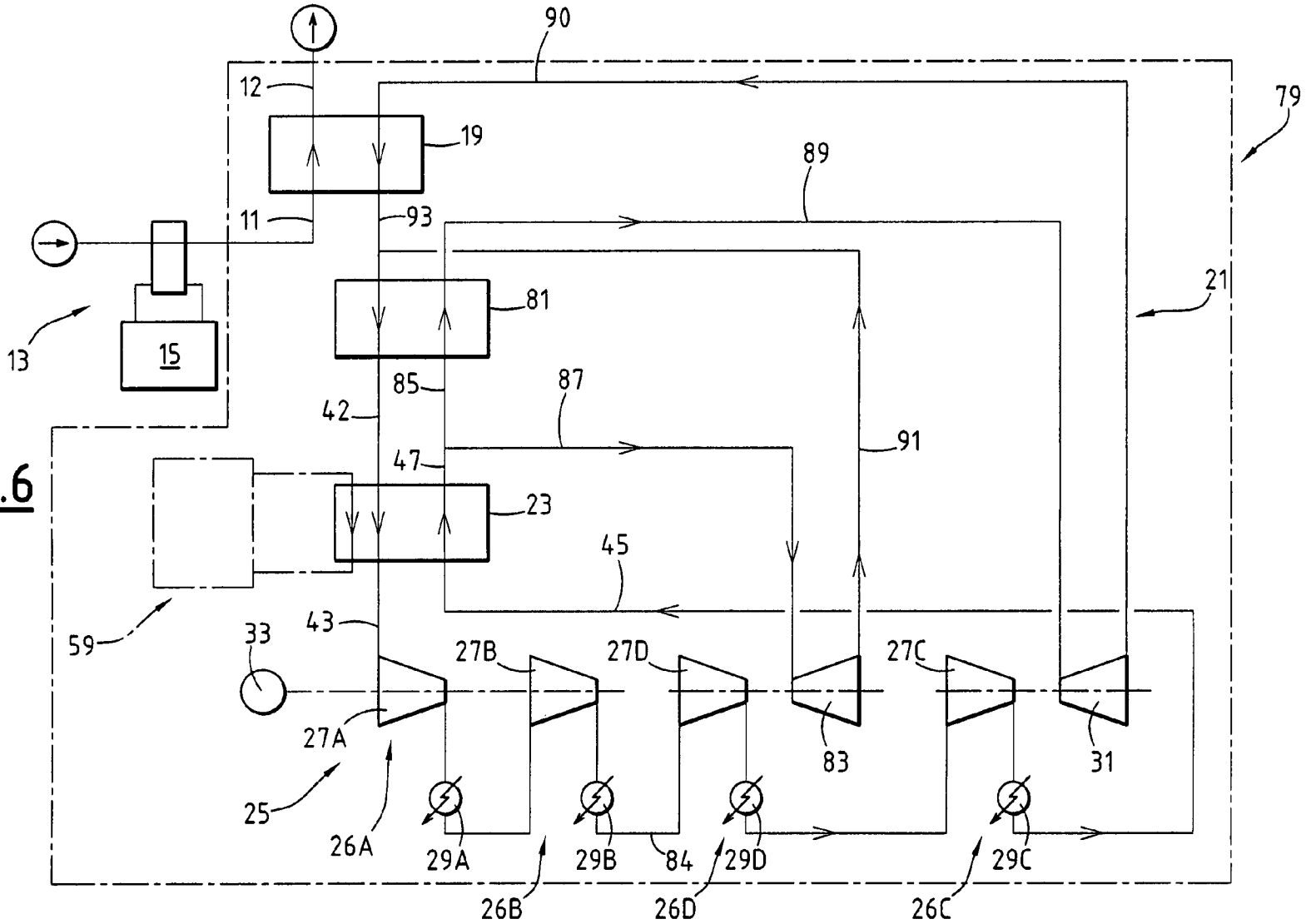
FIG. 6 is a diagram similar to that in FIG. 1 of a second installation according to the invention.

The second installation 79 according to the invention shown in FIG. 6 differs from the first installation 10 in that it further comprises a third heat exchanger 81 interposed between the first heat exchanger 19 and the second heat exchanger 23.

The compression apparatus 25 further comprises a fourth compression stage 26D interposed between the second compression stage 26B and the third compression stage 26C.

The compressor 27D of the fourth stage 26D is coupled to a secondary expansion turbine 83.

The second process according to the invention, carried out in this second installation 79, differs from the first process in that the stream 84 issuing from the second condenser 29B is introduced into the fourth compressor 27D then cooled in the fourth condenser 29D before being introduced into the third compressor 27C.

Furthermore, the compressed cooled stream 47 of refrigerating fluid obtained at the outlet of the second heat exchanger 23 is separated into a sub-cooling stream 85 and a secondary cooling stream 87. The ratio of the flow rate of the sub-cooling stream 85 to the secondary cooling stream 87 is greater than 1.

The sub-cooling stream 85 is introduced into the third heat exchanger 81, where it is cooled to form a cooled sub-cooling stream 89. This stream 89 is then introduced into the turbine 31 where it is expanded. The expanded sub-cooling stream 90 at the outlet of the turbine 31 is in a gaseous form. The stream 90 is introduced into the first heat exchanger 19 where it sub-cools the LNG stream 11 by heat exchange and forms a heated sub-cooling stream 93.

The secondary cooling stream 87 is brought to the secondary turbine 83 where it is expanded to form an expanded secondary cooling stream 91 in a gaseous form. The stream 91 is mixed with the heated sub-cooling stream 93 issuing from the first heat exchanger 19, at a point located upstream of the third heat exchanger 81. The mixture thus obtained is introduced into the third heat exchanger 81 where it cools the sub-cooling stream 85, so as to form the stream 42.

In a variation, the second installation 79 according to the invention has a third refrigeration cycle 59 based on propane or a mixture of ethane and propane which cools the second heat exchanger 23. The third cycle 59 is structurally identical to the third cycles 59 shown in FIGS. 3 and 5 respectively.

Figure 7:
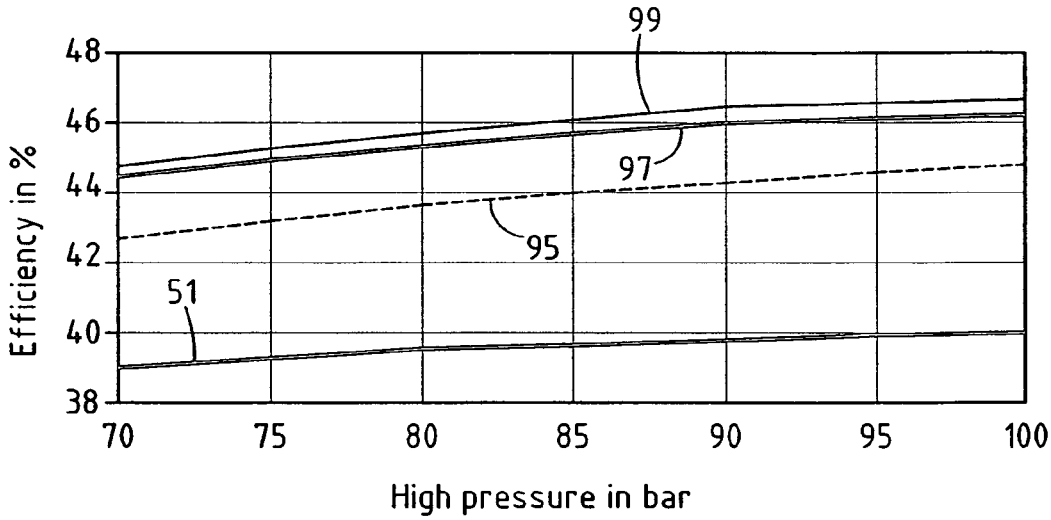
FIG. 7 is a graph similar to that in FIG. 2 for a second installation according to the invention.

FIG. 7 illustrates the curve 95 of the efficiency of the cycle 21 as a function of the high pressure when the installation shown in FIG. 6 is deprived of refrigerating cycle whereas the curves 97 and 99 show the efficiency of the cycle 21 as a function of the pressure when third refrigeration cycles 59 based on propane or a mixture of propane and ethane respectively are used. As shown in FIG. 7, the efficiency of the cycle 21 is increased relative to a cycle comprising solely nitrogen as the refrigerating fluid (curve 51).

Figure 8:
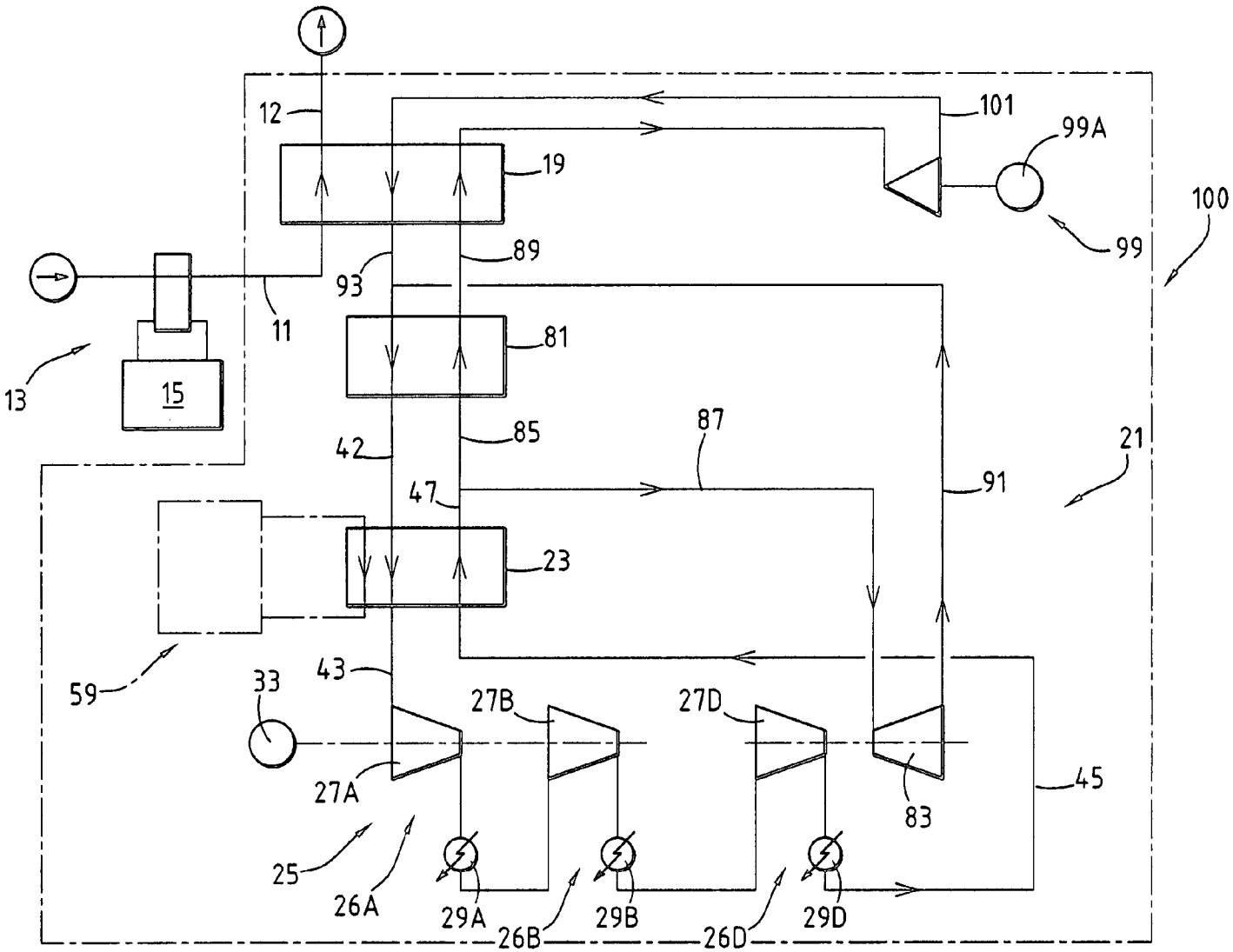
FIG. 8 is a diagram similar to that in FIG. 3 of the third installation according to the invention.

The third installation 100 according to the invention, shown in FIG. 8, differs from the second installation 79 by the following characteristics.

The compression apparatus 25 does not comprise a third compression stage 27C. Furthermore, the installation comprises a dynamic expansion turbine 99 which allows liquefaction of the expanded fluid. This turbine 99 is coupled to a stream generator 99A.

The third process according to the invention, carried out in this installation 100, differs from the second process in the ratio of the flow rate of the sub-cooling stream 85 to the flow rate of the secondary cooling stream 87, which ratio is less than 1.

Furthermore, at the outlet of the third exchanger 81, the cooled sub-cooling stream cooled 89 is introduced into the first heat exchanger 19, where it is cooled again prior to its introduction into the turbine 99. The expanded sub-cooling stream 101 issuing from the turbine 99 is completely liquid.

As a result, the liquid stream 101 is vaporised in the first heat exchanger 19, in a counter-current, on the one hand, to the LNG stream 11 to be sub-cooled and, on the other hand, to the cooled sub-cooling stream 89 circulating in the first exchanger 19.

The secondary cooling stream 91 is in a gaseous form at the outlet of the secondary turbine 83.

In this installation, the refrigerating fluid circulating in the first cycle 21 preferably comprises a mixture of nitrogen and methane, the molar percentage of nitrogen in this mixture being less than 50%. Advantageously, the refrigerating fluid also comprises a $C_2$ hydrocarbon, for example ethylene, in a content of less than 10%. The yield of the process is further improved, as illustrated by the curve 103 showing the efficiency of the cycle 21 as a function of the pressure in FIG. 9.

Figure 9:
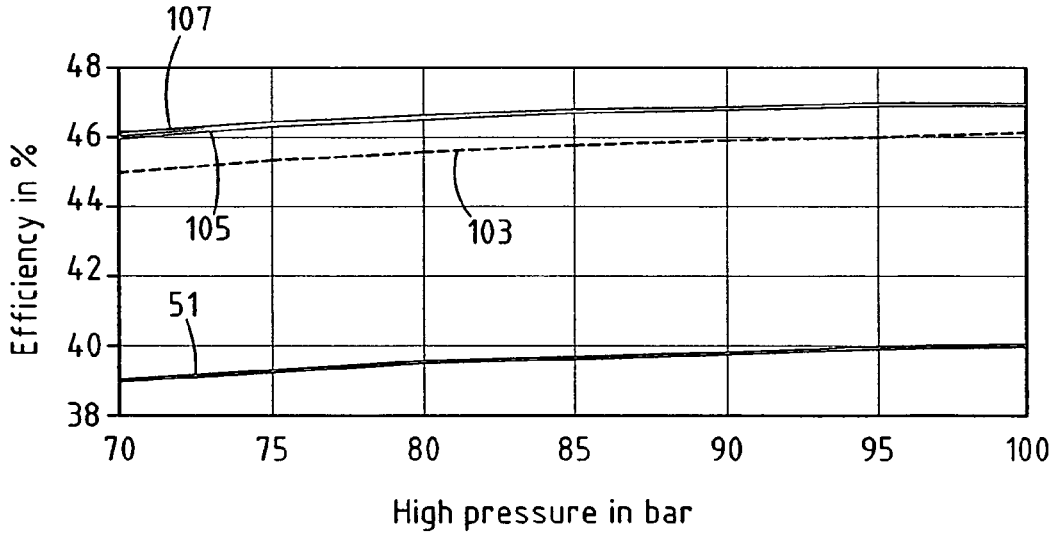
FIG. 9 is a graph similar to that in FIG. 2 for the third installation according to the invention.

In a variation, a third refrigeration cycle 59 based on propane, or based on a mixture of ethane and propane, of the type described in FIGS. 3 and 5, is used to cool the second heat exchanger 23. The curves 105 and 107 representing the efficiency of the cycle 21 as a function of the pressure for these two variations are shown in FIG. 9, and also show an increase in the efficiency of the cycle 21 over the high pressure range concerned.

Thus, the process according to the invention provides a flexible sub-cooling process which is easy to carry out in an installation which produces LNG either as the main product, for example in an LNG production unit, or as a secondary product, for example in a unit for extracting liquids from natural gas (LNG).

The use of a mixture of nitrogen-containing refrigerating fluids for sub-cooling LNG in what is known as a reverse Brayton cycle considerably increases the yield of this cycle, and this reduces the LNG production costs in the installation.

The use of a secondary cooling cycle to cool the refrigerating fluid, prior to the adiabatic compression thereof, substantially improves the yield of the installation.

The efficiency values obtained were calculated with an average temperature difference in the first heat exchanger 19 greater than or equal to 4° C. By reducing this average temperature difference, however, the yield of the reverse Brayton cycle can exceed 50%, which is comparable to the yield of a condensation and vaporisation cycle employing a hydrocarbon mixture conventionally carried out for the liquefaction and sub-cooling of LNG.

The invention claimed is:

1. A process for sub-cooling an LNG stream obtained by cooling using a first refrigeration cycle, the process comprising the following steps:

(a) introducing the LNG stream at a temperature of less than −90° C. into a first heat exchanger;

(b) sub-cooling the LNG stream in the first heat exchanger by heat exchange with a refrigerating fluid comprising a mixture of nitrogen and methane;

(c) subjecting the refrigerating fluid to a closed second refrigeration cycle which is independent of said first cycle, the closed second refrigeration cycle comprising the following successive phases:

(i) heating the refrigerating fluid issuing from the first heat exchanger in a second heat exchanger and keeping the refrigerating fluid at a low pressure;

(ii) compressing the refrigerating fluid issuing from the second heat exchanger in a compression apparatus to a high pressure greater than a critical pressure of the refrigerating fluid;

(iii) cooling in the second heat exchanger the refrigerating fluid originating from the compression apparatus;

(iv) dynamically expanding in a cold turbine at least a portion of the refrigerating fluid issuing from the second heat exchanger to a low pressure;

(v) introducing the refrigerating fluid issuing from the cold turbine into the first heat exchanger; and following step (iii), (iii1) after the refrigerating fluid passes through the second heat exchanger, separating the refrigerating fluid issuing from the compression apparatus into a sub-cooling stream and a secondary cooling stream;

(iii2) expanding the secondary cooling stream in a secondary turbine;

(iii3) mixing the secondary cooling stream issuing from the secondary turbine with the refrigerating fluid stream issuing from the first heat exchanger so as to form a stream of refrigerating mixture;

(iii4) placing the sub-cooling stream issuing from step (iii1) in a heat exchange relationship with the stream of refrigerating mixture in a third heat exchanger; and (iii5) introducing the sub-cooling stream issuing from the third heat exchanger into the cold turbine, wherein the sub-cooling stream issuing from step (iii1) is placed in the heat exchange relationship with the stream of refrigerating mixture in the third heat exchanger, without placing the stream of refrigerating mixture issuing from step (iii1) in a heat exchange relationship with the LNG stream.

2. The process according to claim 1, wherein molar content of methane in the refrigerating fluid is between 5 and 15%.

3. The process according to claim 1, further comprising, during step (iii), placing the refrigerating fluid originating from the compression apparatus in a heat exchange relationship with a secondary refrigerating fluid circulating in the second heat exchanger, and, as a third refrigeration cycle compressing at an outlet of the second heat exchanger, cooling and at least partially condensing, then expanding before vaporizing in the second heat exchanger the secondary refrigerating fluid.

4. The process according to claim 3, wherein the secondary refrigerating fluid comprises propane.

5. The process according to claim 3, wherein the secondary refrigerating fluid comprises a mixture of ethane and propane.

6. The process according to claim 1, wherein the secondary turbine is coupled to a compressor of the compression apparatus.

7. The process according to claim 1, further comprising during step (iv), keeping the refrigerating fluid in a gaseous form in the cold turbine.

8. The process according to claim 1, further comprising during step (iv), liquefying the refrigerating fluid to more than 95% by mass in the cold turbine.

9. The process according to claim 8, further comprising cooling the sub-cooling stream issuing from the third heat exchanger before it passes into the cold turbine by heat exchange with the refrigerating fluid circulating in the first heat exchanger at an outlet of the cold turbine.

10. The process according to claim 8, wherein the refrigerating fluid contains a $C_2$ hydrocarbon.

11. flip process according to claim 8, wherein molar percentage of nitrogen in the refrigerating fluid is less than 50%.

12. The process according to claim 1, wherein the high pressure is greater than 70 bar and the low pressure is less than 30 bar.

13. An installation for sub-cooling an LNG stream originating from a liquefaction unit comprising a first refrigeration cycle, the installation comprising:

a sub-cooling device for the LNG stream comprising a first heat exchanger operable to place the LNG stream in a heat exchange relationship with a refrigerating fluid comprising a mixture of nitrogen and methane; and a closed second refrigeration cycle which is independent of the first cycle and includes:

a second heat exchanger comprising a first circulator operable to circulate refrigerating fluid issuing from the first heat exchanger;

a compression apparatus operable to bring the refrigerating fluid issuing from the second heat exchanger to a high pressure greater than a critical pressure of the refrigerating fluid;

a second circulator operable to circulate the refrigerating fluid issuing from the compression apparatus in the second heat exchanger;

a cold turbine for dynamically expanding at least a portion of the refrigerating fluid issuing from the second heat exchanger; and a device operable to introduce the refrigerating fluid issuing from the cold turbine into the first heat exchanger, a separator operable to separate, after the passage of the refrigerating fluid in the second heat exchanger, the refrigerating fluid issuing from the compression apparatus so as to form a sub-cooling stream and a secondary cooling stream;

a secondary turbine operable to expand the secondary cooling stream;

a mixer operable to mix the secondary cooling stream issuing from the secondary turbine with the refrigerating fluid stream issuing from the first heat exchanger so as to form a stream of mixture;

a third heat exchanger operable to place the sub-cooling stream issuing from the separator in a heat exchange relationship with the stream of mixture; and a second introducing device operable to introduce the sub-cooling stream issuing from the third heat exchanger into the cold turbine, wherein the sub-cooling stream issuing from the separator is placed in the heat exchange relationship with the stream of refrigerating mixture in the third heat exchanger, without placing the stream of refrigerating mixture issuing from the separator in a heat exchange relationship with the LNG stream.

14. The installation according to claim 13, wherein molar content of methane in the refrigerating fluid is between 5 and 15%.

15. The installation according to claim 13, wherein the second heat exchanger comprises a third circulator operable to circulate a secondary refrigerating fluid, the installation comprising a third refrigeration cycle including in succession a secondary compressor operable to compress the secondary refrigerating fluid issuing from the second heat exchanger, a cooling device and an expansion device operable respectively to cool and to expand the secondary refrigerating fluid issuing from the secondary compressor, and an introducing device operable to introduce the secondary refrigerating fluid issuing from the expansion device into the second heat exchanger.

16. The installation according to claim 15, wherein the secondary refrigerating fluid comprises propane.

17. The installation according to claim 15, wherein the secondary refrigerating fluid comprises a mixture of ethane and propane.

18. The installation according to claim 13, wherein the secondary turbine is coupled to a compressor of the compression apparatus.

19. The installation according to claim 13, wherein the cold turbine is operable to liquefy the refrigerating fluid to more than 95% by mass.

20. The installation according to claim 19, wherein molar percentage of nitrogen in the refrigerating fluid is less than 50%.

21. The installation according to claim 13, further comprising upstream of the cold turbine a third introducing device operable to introduce the sub-cooling stream issuing from the third heat exchanger into the first heat exchangers, placing it in a heat exchange relationship with the refrigerating fluid circulating in the first heat exchanger at an outlet of the cold turbine.

22. The installation according to claim 21, wherein the refrigerating fluid contains a $C_2$ hydrocarbon.

23. The process according to claim 5, wherein the mixture comprises 50 mol % ethane and 50 mol % propane.

24. The installation according to claim 17, wherein the mixture comprises 50 mol % ethane and 50 mol % propane.

* * * * *